US011473329B2

(12) United States Patent
Crawley et al.

(10) Patent No.: US 11,473,329 B2
(45) Date of Patent: Oct. 18, 2022

(54) BARRIER SUPPORT FOR A QUEUE MANAGEMENT SYSTEM

(71) Applicant: TENSATOR GROUP LIMITED, Milton Keynes (GB)

(72) Inventors: Peter Crawley, Milton Keynes (GB); Tommy Coe, Milton Keynes (GB); Kevin Hickson, Milton Keynes (GB); Colin Sherwood, Milton Keynes (GB)

(73) Assignee: TENSATOR GROUP LIMITED

( * ) Notice: Subject to any disclaimer, the term of this patent is extended or adjusted under 35 U.S.C. 154(b) by 386 days.

(21) Appl. No.: 16/610,933

(22) PCT Filed: Apr. 30, 2018

(86) PCT No.: PCT/GB2018/051144
§ 371 (c)(1),
(2) Date: Nov. 5, 2019

(87) PCT Pub. No.: WO2018/203041
PCT Pub. Date: Nov. 8, 2018

(65) Prior Publication Data

US 2020/0071948 A1 Mar. 5, 2020

(30) Foreign Application Priority Data

May 5, 2017 (GB) ..... 1707244

(51) Int. Cl.
*E04H 12/22* (2006.01)
*E01F 13/02* (2006.01)

(52) U.S. Cl.
CPC ..... *E04H 12/2238* (2013.01); *E01F 13/022* (2013.01); *E04H 12/22* (2013.01)

(58) Field of Classification Search
CPC .. A47G 1/17; F16B 2001/0035; E01F 13/022; E01F 13/02; E04H 12/2238;
(Continued)

(56) References Cited

U.S. PATENT DOCUMENTS 6,700,064 B2 * 3/2004 Aoki ..... B60R 16/0215 174/69
6,739,567 B1 * 5/2004 Curtis ..... E01F 9/681 248/519

(Continued)

FOREIGN PATENT DOCUMENTS

KR 10-2010-0100452 A 9/2010
WO WO 2004/033803 A1 4/2004

OTHER PUBLICATIONS

International Search Report dated Jul. 11, 2018 in corresponding PCT International Application No. PCT/GB2018/051144.

(Continued)

*Primary Examiner* — Nkeisha Smith
(74) *Attorney, Agent, or Firm* — Ostrolenk Faber LLP

(57) ABSTRACT

A barrier support for a queue management system that includes a post having an upright portion adapted to support at least one barrier device and having at its bottom end a foot and a floor plate. A lower portion of the foot and an upper portion of the floor plate are cooperatively shaped such that the lower portion of the foot can securely fit into and/or over the upper portion of the floor plate and thereby locate the post and one or more magnets are located in the foot and/or the floor plate such that the post can be magnetically secured to the floor plate. The barrier support allows a post to be properly positioned on a floor plate without danger of misalignment and then be held in that position magnetically. The floor plate is circular and has a single centrally located circular aperture faulted therein and the foot is circular and has a single centrally located cylindrical portion that is sized to securely locate in the aperture.

8 Claims, 3 Drawing Sheets

(58) Field of Classification Search
CPC . E04H 12/22; E04H 12/2269; E04H 12/2253; E04H 12/2276; E04H 12/2292; E04H 12/08; E04H 12/10
USPC .. 248/523, 519, 206.5, 346.01, 346.03, 501, 248/502, 506, 507
See application file for complete search history.

(56) References Cited

U.S. PATENT DOCUMENTS

| | | | | |
|---|---|---|---|---|
| 7,618,013 | B2 * | 11/2009 | Elmer | G09F 21/04 248/206.5 |
| 7,690,860 | B1 * | 4/2010 | Utz | E01F 9/677 404/9 |
| 7,862,197 | B2 * | 1/2011 | Gebhard | F21V 21/096 362/191 |
| 9,153,152 | B1 * | 10/2015 | Elmer | H01F 7/0221 |
| 2013/0032773 | A1 | 2/2013 | Jette | 256/65.02 |
| 2013/0153737 | A1 * | 6/2013 | Zoeteman | F16M 13/00 248/513 |
| 2016/0123522 | A1 * | 5/2016 | Hahn | E04H 12/2269 248/523 |
| 2020/0173189 | A1 * | 6/2020 | Curtis | E04H 12/2238 |

OTHER PUBLICATIONS

Written Opinion dated Jul. 11, 2018 in corresponding PCT International Application No. PCT/GB2018/051144.
Combined Search and Examination Report dated Sep. 29, 2017 in corresponding United Kingdom Patent Application No. 1707244.8.

* cited by examiner

BARRIER SUPPORT FOR A QUEUE MANAGEMENT SYSTEM

CROSS-REFERENCE TO RELATED APPLICATIONS

The present application is a 35 U.S.C. §§ 371 national phase conversion of PCT/GB2018/051144, filed Apr. 30 2018, which claims priority to United Kingdom Patent Application No. 1707244.8, filed Apr. 30, 2018, the contents of which are incorporated herein by reference. The PCT International Application was published in the English language.

DESCRIPTION

Field of Invention

The present invention relates to queue management systems such as those in use at post offices, banks, airports, and many other similar locations. These systems comprise a plurality of barrier supports between which barriers, such as rails, webbing, or ropes, are supported. The present invention provides an improved barrier support for such systems that is more securely locatable on a floor.

Background

Queue management systems are well known. Generally, these systems comprise a plurality of barrier supports between which barriers, such as rails, webbing, or ropes are supported. The resulting system directs customers to queue in an appropriate direction and allows them to be served in an orderly manner.

The barrier supports of many queue management system are upstanding posts, each having a heavy foot that supports the post in an upright position. Suitable barriers are then attached at least to an upper end of the post and possibly also a midpoint of the post. Often the barrier will be a retractable webbing that is contained within a cassette that is formed as part of, or affixed to, the post. For example, a simple barrier support consists of a post having a heavy circular foot at a lower end and a cassette at an upper end, from which webbing can be withdrawn to be attached to the upper end of an adjacent barrier support.

There is often a problem in maintaining the position of the barrier supports of queue management systems. Individual barrier supports can be pushed, pulled, or knocked out of position relatively easily and this can result in an untidy or disordered queueing system. In order to overcome this problem barrier supports have been provided with magnetic bases. In particular, magnets are located in a lower surface of the foot of posts and a steel floor plate is provided on the floor. The posts are then located on the steel floor plates and held in position magnetically. This makes it more difficult to knock or move a post without the need to permanently secure the post to the floor.

A barrier support with a magnetic base according to the prior art is shown in FIGS. 1 and 2. The barrier support comprises a post 2 having an upright portion 3 and foot 4 and a floor plate 5. The foot 4 and the floor plate 5 are both circular and have the same diameter. Four magnets 6 are positioned in a lower surface of the foot 4 and equally circumferentially spaced about the foot. Each magnet 6 is located in a recess formed in the lower surface of the foot 4 and are bonded in position in said recess. The foot 4 is formed of cast metal and the floor plate is formed of steel.

The upright portion 3 of the post 2 is bolted to the foot 4 and is positioned centrally with respect to the foot. When in use the floor plate 5 is fixed in a suitable position on the floor. The post 2 is then positioned appropriately on the floor plate 5 such that the foot 4 and the floor plate 5 are aligned. The attraction between the magnets 6 in the foot 4 and the floor plate 5 acts to hold the post 2 in a suitable position.

Although providing a generally good performance the barrier support of the prior art has been found to have some issues. In particular, in some instances the attraction between the magnets 6 and the floor plate 5 has been found to be stronger than the bonding between the magnets 6 and the foot 4 resulting in the magnets 6 becoming dislodged from the post 2 when the post 2 is removed from the floor plate 5. Further, due to the strength of attraction between the magnets 6 and the floor plate 5 it can be difficult for users to precisely align the foot 4 of the post 2 and floor plate 5. In particular, once the foot 4 is positioned on the floor plate 5 it can be difficult to move the foot 4 relative to the floor plate 5 due to the magnetic attraction between the magnets 6 and the floor plate 5. Therefore, it can be difficult to perfectly align the foot 4 with the floor plate 5 if they are initially misaligned. This misalignment can lead to an untidy queueing system, which is undesirable.

In light of the above there is a need for an improved barrier support for a queue management system that overcomes these shortcomings.

SUMMARY OF INVENTION

The present invention provides a barrier support for a queue management system comprising:

- a post having an upright portion adapted to support at least one barrier device and having at its bottom end a foot; and
- a floor plate;

wherein:

- a lower portion of the foot and an upper portion of the floor plate are cooperatively shaped such that the lower portion of the foot can securely fit over the upper portion of the floor plate and thereby locate the post;
- one or more magnets are located in the foot and/or the floor plate such that the post can be magnetically secured to the floor plate; and
- an upper surface of the floor plate has a single aperture formed in an upper surface thereof, the single aperture being circular and centrally located within the floor plate; and
- a lower surface of a lower portion of the foot has one protruding part formed at said surface, the protruding part being cylindrical and centrally located on the lower surface and being positioned and shaped to engage with the single aperture in the floor plate and thereby locate securely locate the post in the floor plate.

The barrier support of the present invention is advantageous as it allows a post to be properly positioned on a floor plate without danger of misalignment and then be held in that position magnetically. This is achieved as a lower portion of the foot and an upper portion of the floor plate are cooperatively shaped such that the lower portion of the foot can fit over the upper portion of the floor plate.

The floor plate has a single aperture formed therein and the foot has a cooperatively positioned protruding part for locating in said aperture. An upper surface of the floor plate and a lower surface of the foot may be formed to be non-planar and interlocking. The foot may have an outer rim that extends around the floor plate when the post is positioned on the floor plate.

In order for the post to be magnetically located on the floor plate it is necessary that one or more magnets are located in one of the lower portion of the foot and the floor plate. If magnets are located in only one of these components then it is necessary that the other component is formed of or has portions that are formed of a ferromagnetic material, such as steel plate, in order to allow the two components to be magnetically held together. If magnets are located in both components it is necessary that the magnets are positioned and located such that they attract correspondingly located magnets in the other component.

In embodiments of the invention one or more magnets may be located in the lower portion of the foot. In such embodiments it may be advantageous that the floor plate is formed of a ferromagnetic material, such as a ferromagnetic cast metal.

In order to allow magnets to be securely located in the foot it may be preferable that the foot is formed of injection moulded plastic. This can allow the one or more magnets to be more easily located and held in position as they will not be magnetically attracted to the material of the foot. If the foot is formed of injection moulded plastic it is generally preferable that the one or more magnets are screwed or bolted in position in the foot. This can be achieved in any manner apparent to the person skilled in the art. For example, the foot may be moulded to have specific fixings in which magnets can be located and screwed or bolted in position. Screwing or bolting magnets in position in an injection moulded plastic foot has been found to be a more resilient and accurate construction than bonding magnets in a metal foot. In particular, in such barrier supports magnets can be better retained in the foot and can be more accurately located in the foot. If a foot is formed of injection moulded plastic it may have an upper metal covering in order to provide a better appearance when the barrier support is in use.

A barrier support according to the present invention may comprise substantially any number of magnets and those magnets can be provided in any suitable arrangement. In an embodiment of the invention the magnets are located in the foot and there are six or more magnets that are equally circumferentially spaced around the lower portion of the foot. Providing a larger number of magnets, in particular six or more, and equally circumferentially spacing the magnets around the lower portion of the foot can provide an excellent uniform attraction between the foot and the floor plate.

As set out above, the barrier support of the present invention is advantageous in that a lower portion of the foot and an upper portion of the floor plate are cooperatively shaped such that post can be securely and accurately located on the floor plate without difficulty. In the invention the floor plate has a single aperture formed in an upper surface thereof; and the foot portion has one downwardly protruding part formed at its lower surface, the downwardly protruding part being positioned and shaped to engage with the aperture and thereby locate securely locate the post in the floor plate. The aperture is located in the floor plate and the protruding part is formed at the lower part of the foot portion of the post in order to avoid the need to have an upwardly protruding part on the floor plate, which, as will be readily understood, can be disadvantageous if the floor plate is left in position without a post positioned thereon.

In order to allow a post to be easily located on a floor plate it may be advantageous that the aperture of the floor plate is chamfered at its upper edge to allow easy location of the post in the floor plate. Providing the aperture with a chamfered upper edge means that the cooperatively formed protruding part of the lower portion of the foot can be more easily engaged with the aperture but still allows the protruding part to be accurately and securely located in the aperture.

The floor plate has a single aperture formed in an upper surface thereof and the foot portion has one downwardly protruding part. This provides a simple and robust construction that allows easy location of the post on the floor plate. The floor plate has a single aperture that is circular and centrally located within the floor plate; and a lower portion of the foot has a single downwardly protruding part that is cylindrical and centrally located on a lower surface thereof. Providing both the aperture and the downwardly protruding part centrally in the floor plate and the lower portion of the foot respectively ensures that the post can be accurately located on the floor plate utilising a single aperture and corresponding downwardly protruding part. Further, making both the aperture and the downwardly protruding part circular allows for easier location of the post on the floor plate, avoiding the need for precise rotational alignment.

As precise rotational alignment of the post relative to the floor plate is not required due to the aperture and the downwardly protruding part both being circular and centrally positioned, it is generally preferable that both the floor plate and the foot are circular and therefore rotationally symmetric. This is preferable as in such embodiments the rotational alignment of the post and the floor plate is not required.

Generally in barrier supports according to the present invention it is preferable that the floor plate is not immediately visible to users of the queueing system. In order to achieve this it may be preferable that a lower surface of the foot is shaped to match an upper surface of floor plate such that when in use the foot completely covers but does not extend beyond the upper surface of the floor plate.

In embodiments where the lower surface of the foot is shaped to match an upper surface of the floor plate it may be advantageous that the foot has an outer downwardly extending rim shaped to extend around an outer circumference of the floor plate when the post is positioned on the floor plate such that the floor plate is not visible when the post is positioned thereon. This feature can provide a more pleasing appearance to the barrier support and can be a feature that allows accurate location of the foot on the floor plate.

Further features and advantages of the present invention will be apparent from the embodiment of the invention that is shown in FIGS. 3 to 6 and is described below.

DRAWINGS

Figure 1:
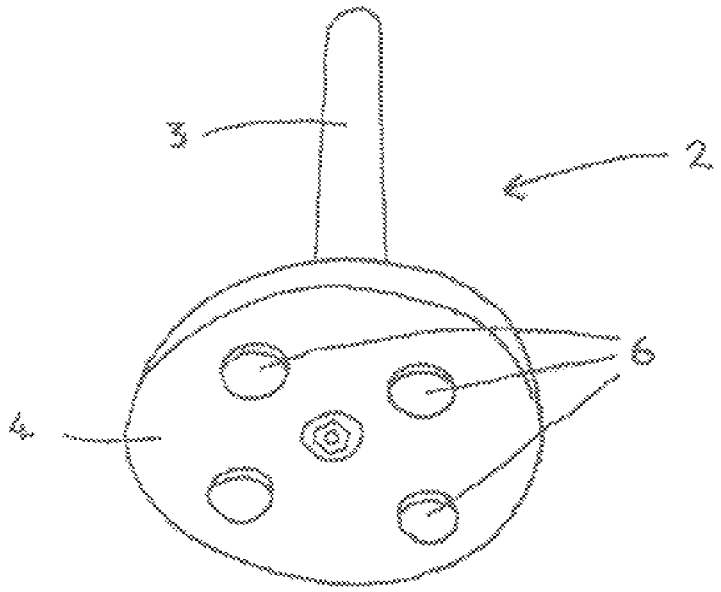
Figure 1 PRIOR ART
FIG. 1 is a schematic of a post of a barrier support according to the prior art.
Figure 2:
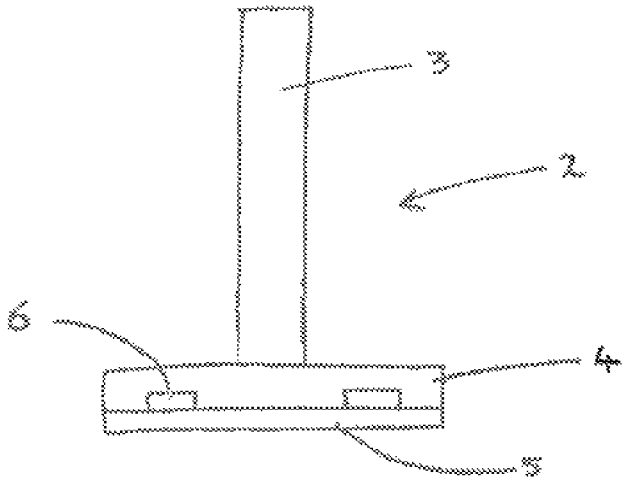
Figure 2 PRIOR ART
FIG. 2 is a vertical cross-section of a barrier support according to the prior art.
Figure 3:
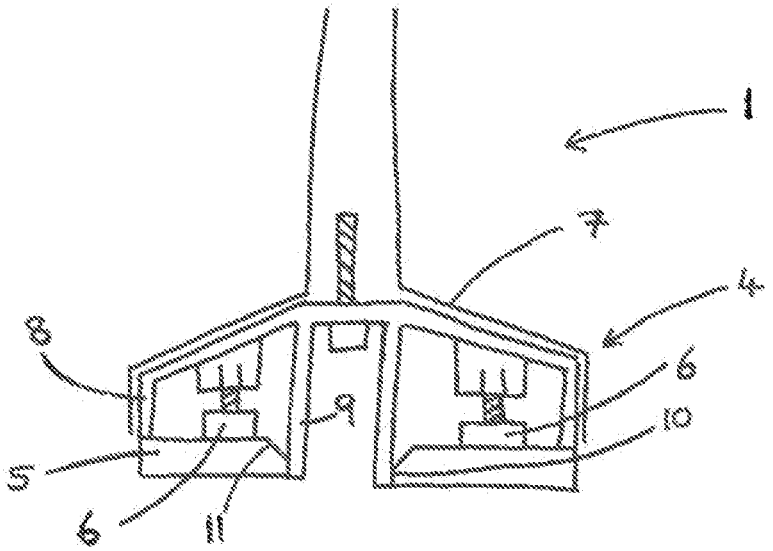
FIG. 3 is a vertical cross-section through a barrier support according to an embodiment of the present invention.
Figure 4:
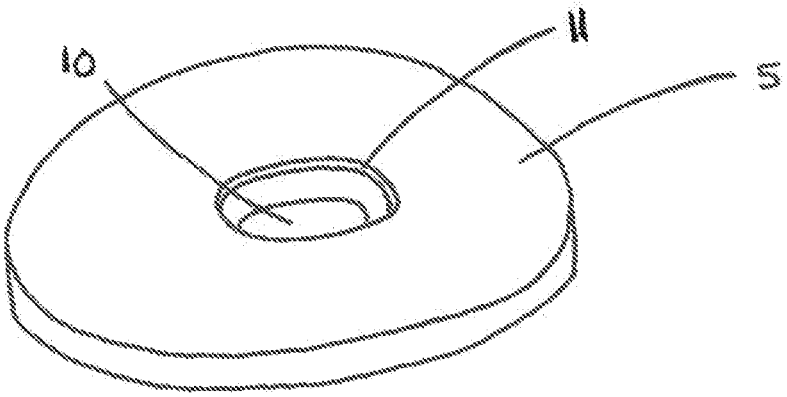
FIG. 4 shows a floor plate of the barrier support of FIG. 3.
Figure 5:
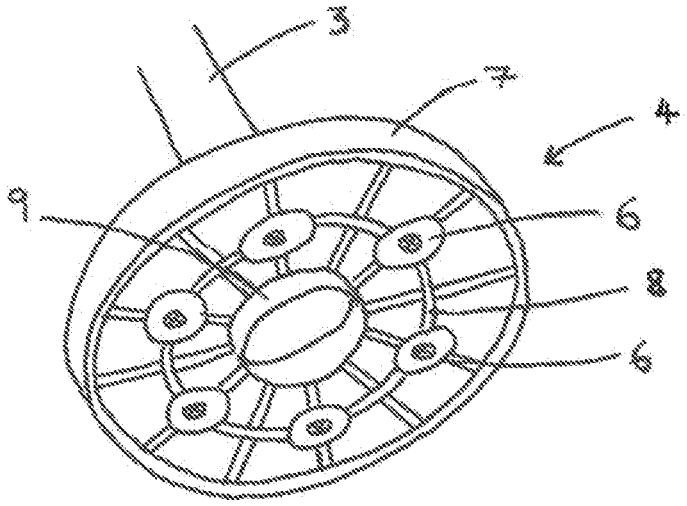
FIG. 5 shows a lower portion of a post of the barrier support of FIG. 3.
Figure 6:
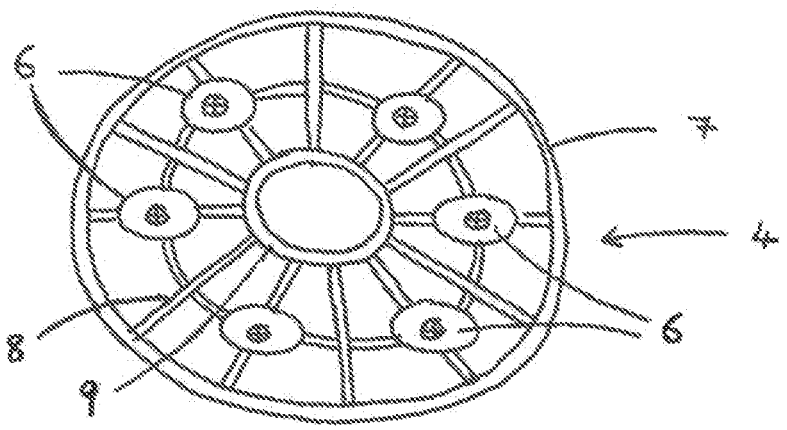
FIG. 6 is a plan view of the lower end of the post of FIG. 5.

Details of a barrier support 1 according to an embodiment of the present invention are shown in FIGS. 3 to 6. The barrier support 1 of the Figures consists of a post 2 having a substantially cylindrical foot 4 formed at a lower end of an upright portion 3 and a floor plate 5. The upright portion 3 is bolted to the foot 4. The foot has an outer metal cover 7 surrounding an injection moulded plastic body 8. Six magnets 6 are bolted in position in the body 8. The magnets 6 are equally circumferentially spread around the body 8. The body 8 has a central cylindrical portion 9 that extends downwards from its lower surface. An upper end of the upright portion 3 has a cassette (not shown) attached thereto. The cassette contains a length of retractable webbing that can be attached to an adjoining barrier support 1 to form a queueing system.

The floor plate 5 is formed of steel plate. The floor plate 5 is substantially circular and has a circular central aperture 10 that is sized to match the cylindrical portion 9 of the body 8. In particular, the central aperture 10 is sized such that when the post 2 is positioned on the floor plate 5 the cylindrical portion 9 of the body 8 is located in the central aperture and this properly locates the post 2 on the floor plate 5 such that the post 2 cannot be moved horizontally with respect to the floor plate 5. In order to allow cylindrical portion 9 of the body 8 to be easily located in the central aperture 10, the upper edge 11 of the central aperture 10 is chamfered.

The barrier support 1 can be used in the following manner. First, the floor plate 4 is positioned in an appropriate position on a floor and fixed in position. The post 2 is then positioned on top of the floor plate 4. This is done by positioning the central cylindrical portion 9 of the foot 4 in the central aperture 10 of the floor plate 4. The chamfered edge 11 of the central aperture allows the cylindrical portion 9 to be easily located in the central aperture 10. When placed in position the magnets 6 will act to hold the post 2 to the floor plate 4. The webbing can then be extended from the cassette of the upper portion 3 to an adjoining barrier support to form a queueing system. In this manner, a barrier support 1 for a queueing system can be easily, securely, and accurately located in position on a floor plate 4 and magnetically held in position on said floor plate 4.

The invention claimed is:

1. A barrier support for a queue management system comprising:

a post having an upright portion adapted to support at least one barrier device and having at its bottom end a foot; and a floor plate;

wherein:

a lower portion of the foot and an upper portion of the floor plate are cooperatively shaped such that the lower portion of the foot can securely fit over the upper portion of the floor plate and thereby locate the post, the lower portion of the foot being formed of injection moulded plastic;

six or more magnets equally circumferentially spaced in the lower portion of the foot such that the post can be magnetically secured to the floor plate;

an upper surface of the floor plate has a single aperture formed in an upper surface thereof, the single aperture being circular and centrally located within the floor plate; and a lower surface of a lower portion of the foot has one protruding part formed at said surface, the protruding part being cylindrical and centrally located on the lower surface and being positioned and shaped to engage with the single aperture in the floor plate and thereby locate securely locate the post in the floor plate.

2. The barrier support according to claim 1, wherein the floor plate is formed of a ferromagnetic material.

3. The barrier support according to claim 2, wherein the floor plate is formed of cast metal.

4. The barrier support according to claim 1, wherein each of the one or more magnets are bolted in position in the barrier support.

5. The barrier support according to claim 1, wherein an upper edge of the single aperture of the floor plate is chamfered to allow easy location of the post in the floor plate.

6. The barrier support according to claim 1, wherein the floor plate and the lower portion of the foot are circular.

7. The barrier support according to claim 1, wherein a lower surface of the foot is shaped to match an upper surface of floor plate such that when in use the foot completely covers but does not extend beyond the upper surface of the floor plate.

8. The barrier support according to claim 1, wherein the foot has an outer downwardly extending rim shaped to extend around an outer circumference of the floor plate when the post is positioned on the floor plate such that the floor plate is not visible when the post is positioned thereon.

* * * * *